US006510613B1

(12) United States Patent
Wall

(10) Patent No.: US 6,510,613 B1
(45) Date of Patent: Jan. 28, 2003

(54) ERGONOMIC CAN OPENER

(75) Inventor: Eric S. Wall, Clinton, MO (US)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/621,101

(22) Filed: Jul. 20, 2000

(51) Int. Cl.[7] ..... B67B 7/46
(52) U.S. Cl. ..... 30/410; 30/427; 30/434
(58) Field of Search ..... 30/400, 410, 418, 30/421, 425, 427, 434; D8/33, 36

(56) References Cited

U.S. PATENT DOCUMENTS

| | | | | |
|---|---|---|---|---|
| 2,204,368 | A | 6/1940 | Kublin | 30/15 |
| 2,896,319 | A | 7/1959 | Pinette | 30/4 |
| 2,979,815 | A | 4/1961 | Rohde et al. | 30/4 |
| 2,997,785 | A | 8/1961 | Pinette | 30/4 |
| 3,079,683 | A | 3/1963 | Carew et al. | 30/4 |
| 3,105,297 | A | 10/1963 | Clowers | 30/6.4 |
| 3,156,044 | A | 11/1964 | Congdon et al. | 30/4 |
| 3,176,063 | A | 3/1965 | Jepson et al. | 174/52 |
| 3,216,108 | A | 11/1965 | Jepson et al. | 30/4 |
| 3,254,406 | A | 6/1966 | Hubrich | 30/4 |
| 3,307,255 | A | 3/1967 | Hubrich | 30/4 |
| 3,313,023 | A | 4/1967 | Jepson et al. | 30/4 |
| 3,348,305 | A | 10/1967 | Bielak | 30/4 |
| 3,360,853 | A | 1/1968 | Chambers et al. | 30/4 |
| 3,376,671 | A | 4/1968 | Wolter | 51/5 |
| 3,477,263 | A | 11/1969 | Jepson et al. | 72/71 |
| 3,520,056 | A | 7/1970 | Scott | 30/4 |
| 3,585,717 | A | 6/1971 | Bielak et al. | 30/4 |
| 3,673,682 | A | 7/1972 | Yamamoto | 30/4 |
| 3,675,321 | A | 7/1972 | Arel et al. | 30/4 |
| 3,689,997 | A | 9/1972 | McLean | 30/4 |
| 3,706,135 | A | 12/1972 | Fukenaga et al. | 30/4 |
| 3,765,085 | A | 10/1973 | Ponczek et al. | 30/4 |
| 3,805,380 | A | 4/1974 | Yamamoto | 30/4 |
| 3,858,313 | A | 1/1975 | Yamaguchi | 30/4 |
| 3,881,247 | A | 5/1975 | Niwa | 30/4 |
| 3,911,571 | A | 10/1975 | Ponczek et al. | 30/4 |
| 3,942,247 | A | 3/1976 | Ponczek et al. | 30/6.5 |
| 3,949,468 | A | 4/1976 | McLean et al. | 30/4 |
| 3,955,276 | A | 5/1976 | Pauty | 30/4 |
| 4,028,805 | A | 6/1977 | Figlia | 30/403 |
| 4,053,981 | A | 10/1977 | Aberer | 30/4 |
| 4,207,676 | A | 6/1980 | Okumura | 30/419 |
| D276,406 | S | 11/1984 | Johnson et al. | D8/41 |
| 4,534,108 | A | 8/1985 | Yamamoto et al. | 7/152 |
| 4,561,182 | A | 12/1985 | Yamamoto et al. | 30/433 |
| 4,733,472 | A | 3/1988 | Belcourt | 30/422 |
| 4,831,735 | A | 5/1989 | Bast et al. | 30/433 |
| 4,922,617 | A | 5/1990 | Kurz | 30/419 |
| 4,995,164 | A | 2/1991 | Borger et al. | 30/423 |
| 5,313,708 | A | 5/1994 | Edwards et al. | 30/417 |
| D410,827 | S * | 6/1999 | Conrado et al. | D8/36 X |

* cited by examiner

*Primary Examiner*—Douglas D. Watts
(74) *Attorney, Agent, or Firm*—Brinks Hofer Gilson & Lione

(57) ABSTRACT

An ergonomic, electric can opener sits squarely on a kitchen counter and has working features such that the user need not turn the opener to see where to place the can. The housing and working features of the can opener are situated at about a 45 degree angle to the front of the kitchen counter, and a person using the can opener can easily see both an operating lever and a place to insert the can for opening. The can opener is advantageous to persons with arthritic conditions, requiring no orientation in a preferred direction by a user, a minimum of force to operate, and automatic stopping.

4 Claims, 8 Drawing Sheets

ERGONOMIC CAN OPENER

BACKGROUND OF THE INVENTION

The conveniences of daily life extend to the kitchen and to the many types of foods available year-round through modern preservation and canning techniques. While a great variety of foodstuffs is available in glass and plastic containers having screw-off lids, even more are available in "canned" form, that is, in a steel can, protected by a very thin coating of tin, and hermetically sealed from the outside environment. These cans are opened by a conventional can opener, which may be a hand-crank, a simple, hand-operated instrument, or an electric can-opener, using an internal electric motor to rotate the can against a cutting surface and thus to open the can. Such electric can openers are commonplace, and are distinguished by their reliability, ease of use, and overall convenience.

However, there is still room for improvement in these appliances, in that some persons, such as those with limited use of their hands, may find such appliances as presently constituted difficult to use. In particular, persons with arthritic conditions may find difficult the process of using a conventional electric can opener. Approaching a typical can opener from the front, the user may not be able to see the point of insertion, a serrated wheel to rotate a can, because it is hidden by a magnet assembly used to retain the severed can lid. To use an electric can opener, most right-handed persons will grasp a can in their left hand and the can opener in the right hand. The right hand is then used to orient and stabilize the can opener, typically by manipulating the opener so the user can see the wheel and more easily access the opener.

The can is then inserted under the serrated rotating wheel, which is operably connected to an electric motor for rotating the can. Once the can is inserted, the control lever is depressed, activating the electric motor to rotate the can against a cutting surface until the lid of the can is severed. It would be a great convenience to persons having limited use of their hands if they could more easily see the wheel and its relationship to the cutting surface, and thus would not need to grasp and rotate the can opener prior to use. Of course, there exist can openers which may be fixed in place, such as large, institutional openers, permanently oriented, but these can openers, being bolted into place, require the user to sacrifice the flexibility that portable appliances offer in a household kitchen. What is needed is an electric can opener that allows the user to see the rotating wheel without turning the can opener, where the can opener is sufficiently stable without being bolted to the counter-top, and also does not take up a great deal of counter space in the kitchen.

BRIEF SUMMARY OF THE INVENTION

This invention solves these problems by means of a new, ergonomic electric can opener. Recognizing that the person opening the can needs to see the rotating wheel without having to turn the can opener is the key to solving the problem. An electric can opener whose base is oriented "square" with a typical countertop, but whose housing is then rotated by about 30 to 90 degrees clockwise to that base, solves the problem.

Conventional can openers are typically square or rectangular in construction, having a front and back, and left and right sides. The base area is usually greater than the cross-sectional area of the housing to provide a stable platform for the can opener. Such a can opener will typically be placed on a kitchen counter-top in a manner that is "square with the world," i.e., with the back of the can opener facing a back wall of the counter-top, and the front of the can opener toward the front of the counter. An operating lever of such a can opener will then be oriented toward the right side of the can opener, while the cutter and the rotating wheel (the point of insertion of the can) are on the front side.

In the improved can opener of the invention, the user need not grasp the can opener and rotate it. Instead, the housing of the can opener is molded and positioned at an angle to the suggested orientation of the molded base. Thus, when the user approaches the countertop and the can opener upon it, the user can see the serrated rotating wheel, and the point of insertion of the can into the can opener. The serrated wheel is on a surface on the user's left, while the operating lever is on a surface to the user's right. Instead of having to grasp and turn the can opener, the user lifts the operating lever, positions the can into its point of insertion, and depresses the operating lever to begin the process of opening the can. At the same time, a base of the can opener has features that are "square with the world" for easy orientation by the user with an external feature, such as a front edge of the countertop or the tabletop.

One embodiment of the invention is an ergonomic, electric can opener comprising a base and a housing mounted on top of the base. The base may be square or rectangular, with its front and back sides parallel to each other and positioned parallel to a countertop upon which the can opener is placed. In this orientation, the left and right sides of the base are perpendicular to the front and back sides, and are also perpendicular to the front edge of the countertop. The housing may be square or rectangular, and is mounted on top of the base, but is rotated through a vertical axis about 45 degrees from the base. That is, the entire top, along with the operable features of the can opener, is rotated about 45 degrees clockwise from its conventional position. The can opener further comprises a feed wheel operably connected to a motor and a switch for operating the motor, and an operating lever. The feed wheel and the operating lever, along with a cutting surface mounted on the housing, constitute the operable features of the invention.

DETAILED DESCRIPTION OF THE INVENTION

Figure 1:
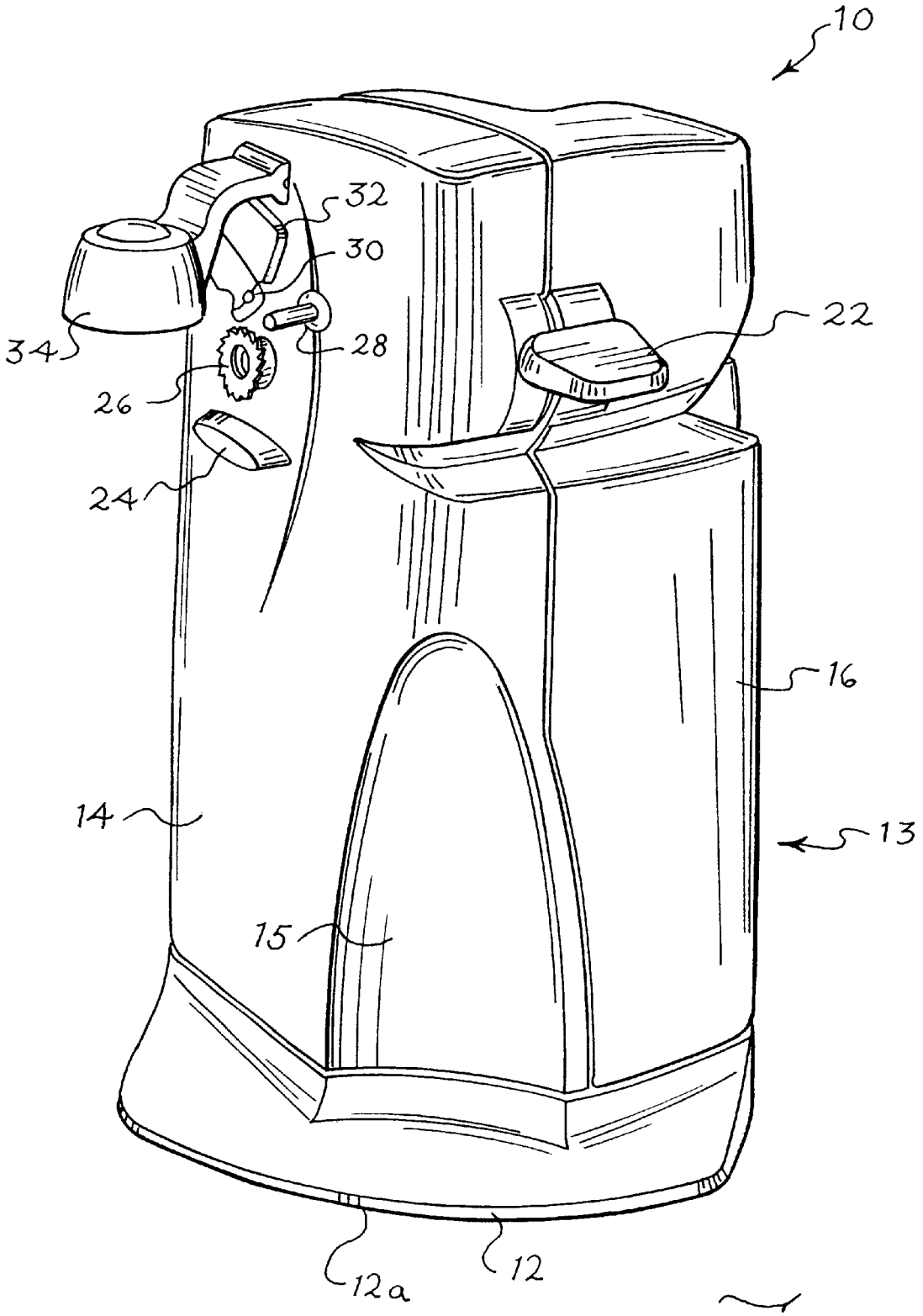
FIG. 1 is a perspective view of a first embodiment of the invention.

FIG. 1 is a perspective view of an embodiment of the present invention, an ergonomic electric can opener 10. The can opener has a base portion 12 and a housing portion 13. Housing portion 13 has a left front 14 and a right front 16, in which the left front and right front are oriented at about 45 degrees from a front side 12*a* of base 12. A scallop 15 may be part of the design for the can opener, for instance to make the can opener easier to grasp when it is moved for cleaning and the like. The can opener is depicted as it is meant for use on a counter-top, such as a kitchen counter-top (not shown), with a front edge 12*a* of the base 12 oriented generally parallel to the front edge of the counter-top, and facing straight at a user. Shown also in FIG. 1 is an operating lever 22, a can guide boss 24 and a serrated wheel 26 that rotates a can while it is being opened by cutting edge 30, the cutting edge assembled as part of a cam 32. Guide pin 28 helps orient a can into position for opening. Magnet holder assembly 34 holds a lid after it is severed from a can. A user approaching the can opener from the front does not need to rotate the can opener to see at least a portion of the top of serrated rotating wheel 26, the point of insertion of a can into the can opener.

Figure 2:
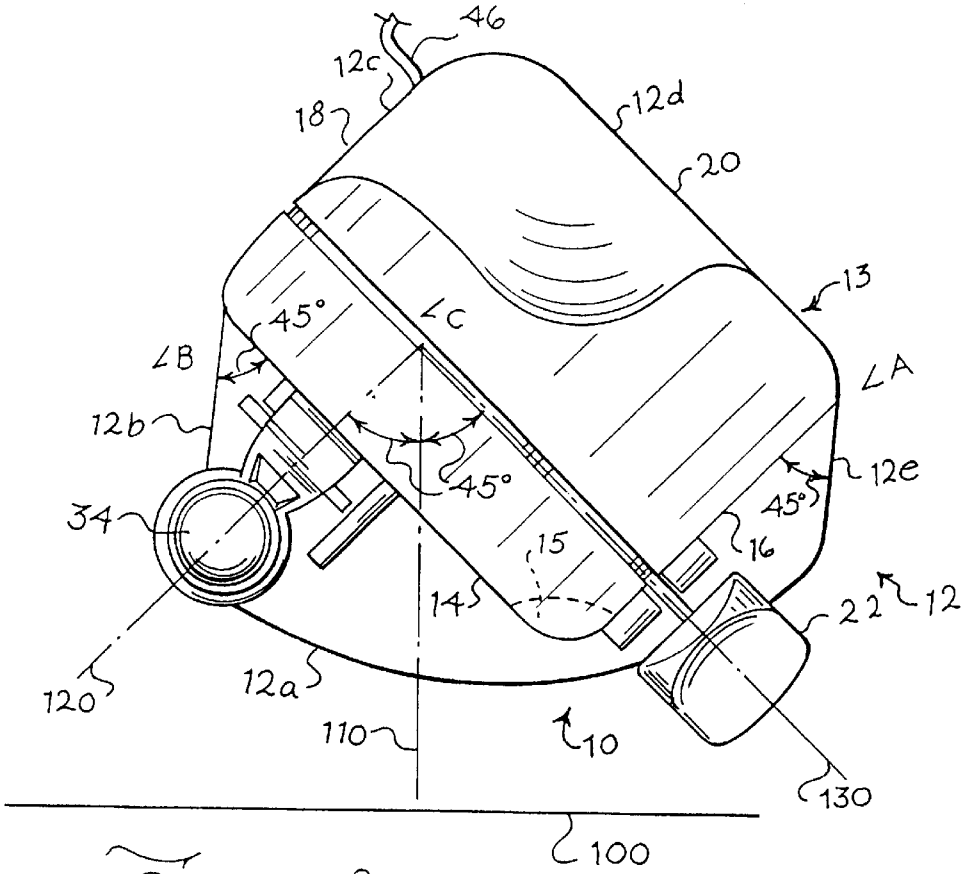
FIG. 2 is a top view of the first embodiment of the invention.

FIG. 2 is a top view of the ergonomic electric can opener of FIG. 1, depicting the base 12 of the can opener, and showing how the front base is aligned parallel with a kitchen counter-top edge 100. It can also be seen from this figure that the can opener has a base having five sides, 12*a*, 12*b*, 12*c*, 12*d* and 12*e*, and a housing 13 with four sides, 14, 16, 18 and 20. The four sides of the housing 13 are angled at about a 45-degree angle to sides 12*b*, 12*e* of base 12. This 45-degree angle will be along a vertical axis passing through the height of the can opener, that is, an axis into the paper in FIG. 2. Line 110, bisecting the can opener, is perpendicular to the counter-top edge 100. A user approaching the can opener from the front along line 110 will be able to see the operating lever 22 and top of the feed wheel (as shown in FIG. 1) without having to touch or orient the can opener. Power for a motor is supplied through electric cord 46.

FIG. 2 also shows that the left front 14 and right front 16 are oriented at angles to the countertop in front In particular, a line 120 through the magnet holder 34 will form an angle of about 45 degrees with line 110. Another line 130 that runs through the operating lever 22 will be at about 45 degrees to line 110. Also shown in FIG. 2 are a left rear side 18 and a right rear side 20, left rear side 18 parallel to right front side 16 and right rear side 20 being parallel to left front side 14. As is clear from FIG. 2, the lines of operation of the operating lever and the point of can insertion, along the magnet holder, are at right angles to each other and to the orientation of the left and right front sides 14, 16. While this is not essential for operation, a can opener is made easier to manufacture and assemble if this configuration is maintained. Thus, in one aspect of the invention, the operable features are maintained at right angles to each other and to the sides of the housing. In another aspect, lines drawn through the serrated wheel and the operating lever will be oriented about 45 degrees from the front of the counter-top, and also from the left and right sides of the base of the can opener.

The construction of the can opener in various embodiments may best be understood by reference to the orientation of the operating features. Since the point of the ergonomic can opener is to ease handling and to minimize the manipulation of the opener by a user, the can opener should be placed so that the operating features, that is, the operating lever and the serrated wheel, are oriented as in FIG. 2. The can opener is oriented on a tabletop or counter top with the serrated wheel and the operating lever at angles of about 45 degrees to a front edge of the tabletop or counter top. With these features so oriented, a user need not grasp and rotate the can opener to insert a can and operate it. At the same time, the can opener has other visual cues so that the user can comfortably orient the can opener by sides parallel or perpendicular to the tabletop or counter top.

Visual cues are features of the environment used by the operator to orient himself or herself with respect to the can opener. The easiest and most obvious visual cue is a front of a countertop. If the front is not linear, then a back wall will serve for this orientation. Other features of a food-service area that may be used for such orientation could include, but are not limited to, an appliance surface, such as a side of a refrigerator; a back wall, such as a back wall of a kitchen; a sink side or edge; or any other similar surface that is parallel or perpendicular to a line of sight of a user. Thus, an orienting feature may be a sidewall, a front wall, a back wall, an edge, and so on. This is the reason for having a base and a housing mounted upon the base: the base cues the user to orient the can opener "square" with the orienting feature, such as a counter top or table-top, while the housing orients the operating features for ease of use.

Figure 9:
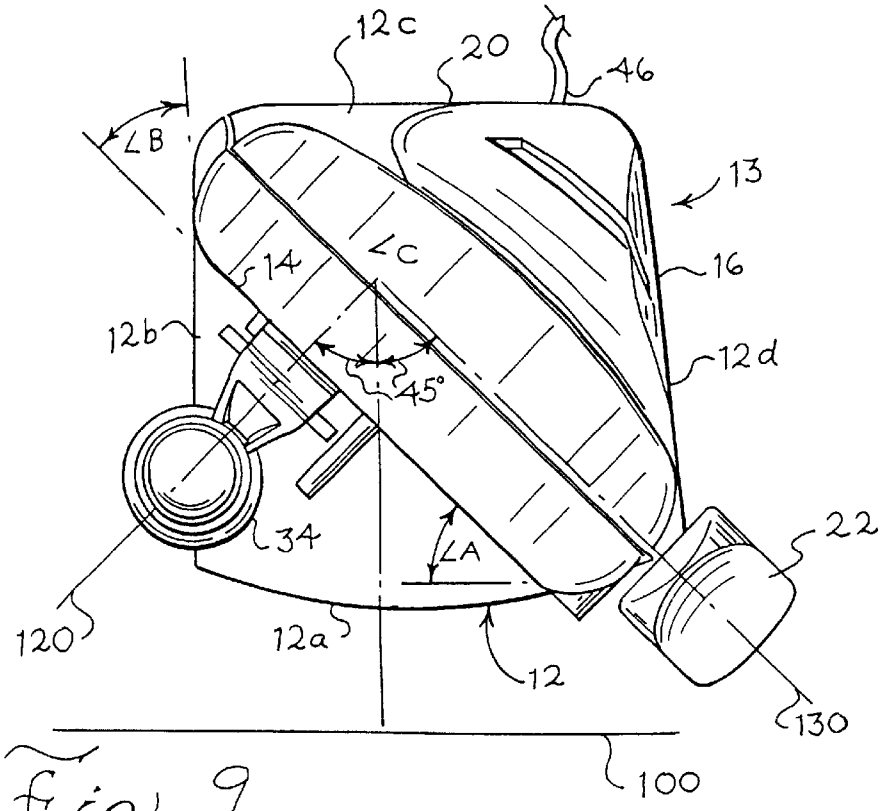
FIG. 9 is a top view of the second embodiment of the invention.

The intended frontal orientation of such a can opener may not always be apparent, and the preferred embodiment of the invention builds in visual cues to a user as to the proper orientation of the can opener. Visual cues to the user as to the "proper" orientation of the can opener are important. These visual cues may be perceived from other structure, especially the sides of the base being parallel or perpendicular to a counter top or tabletop on which the can opener is placed. Thus, in FIG. 2, with the can opener and its operating features in the 45-degree orientation, sides 12*b* and 12*e* are perpendicular to the front edge 100 of the counter top or tabletop. A user is able to place the can opener in its preferred orientation by means of this preferred structure. In another embodiment, shown in FIG. 9, a three-sided housing is mounted upon a four-sided base. A user can visually align front edge 12*a* parallel to a front edge 100 of a countertop, while maintaining a 45-degree angle for the operating features. Another, secondary visual cue to a user is that the power cord should be at the rear of the can opener, as shown in FIGS. 2, 4, 5 and 9. A better method, however, is to realize that the advantage of the can opener is that a user should see both the serrated wheel and the operating lever without moving the opener. Thus, the preferred situation of the can opener is for lines through the operating features to be oriented about 45 degrees to the front edge of a countertop, as shown in FIGS. 2 and 9. As discussed below, the angle need not be only 45 degrees.

Figure 3:
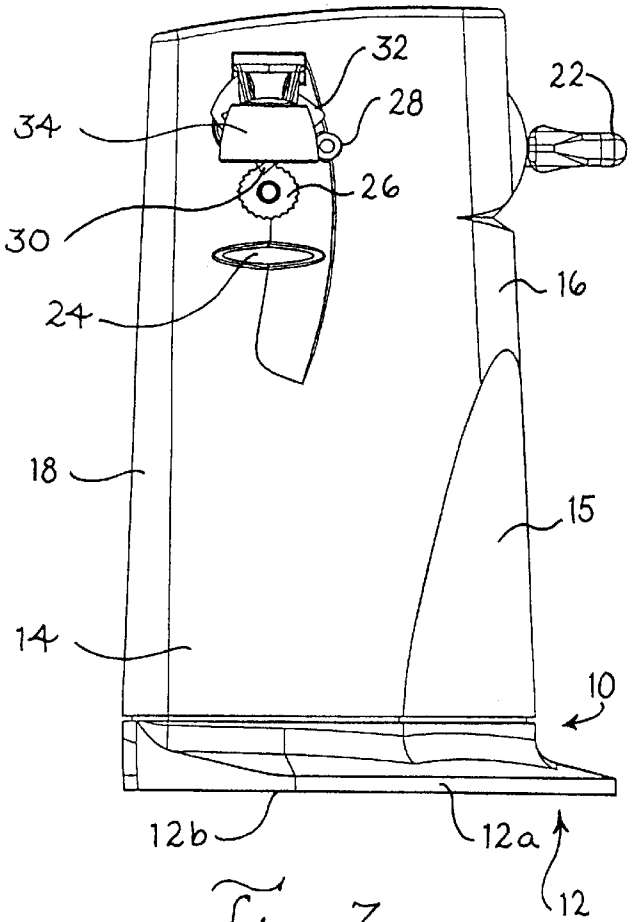
FIG. 3 is a front view of the first embodiment of the invention.
Figure 4:
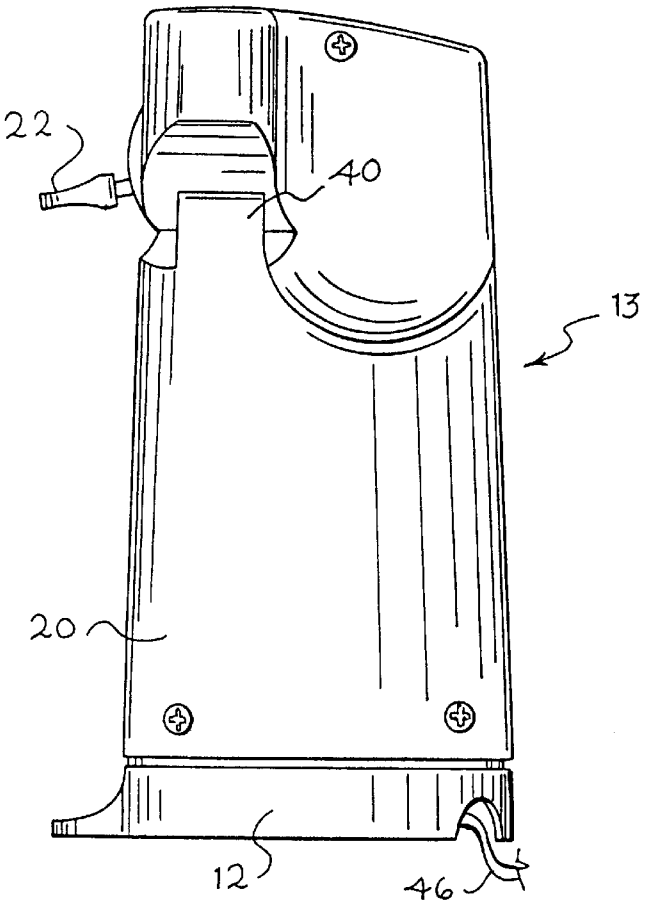
FIG. 4 is a back view of the first embodiment of the invention.

FIG. 3 is a view from the left front side 14 of the can opener 10 of the present invention. As can be seen from the figure, the sides 14, 16 and 18 are at an angle with the base 12, and base sides, 12*b* of the can opener. Scallop 15 is easily seen, as is operating handle 22 protruding from the right front surface 16 of the can opener. From the left front side 14 of the can opener, visible are a can guide boss 24, serrated rotating wheel 26, can guide pin 28, cutting surface 30, cam surface 32, and magnetic holder assembly 34. FIG. 4 is a similar view from the rear, depicting the rear 20 of housing 13 and base 12, with electrical cord 46. Visible also is operating lever 22, and in this embodiment, a gap 40 in the housing to accommodate a blade sharpener as an added feature of the can opener.

Figure 5:
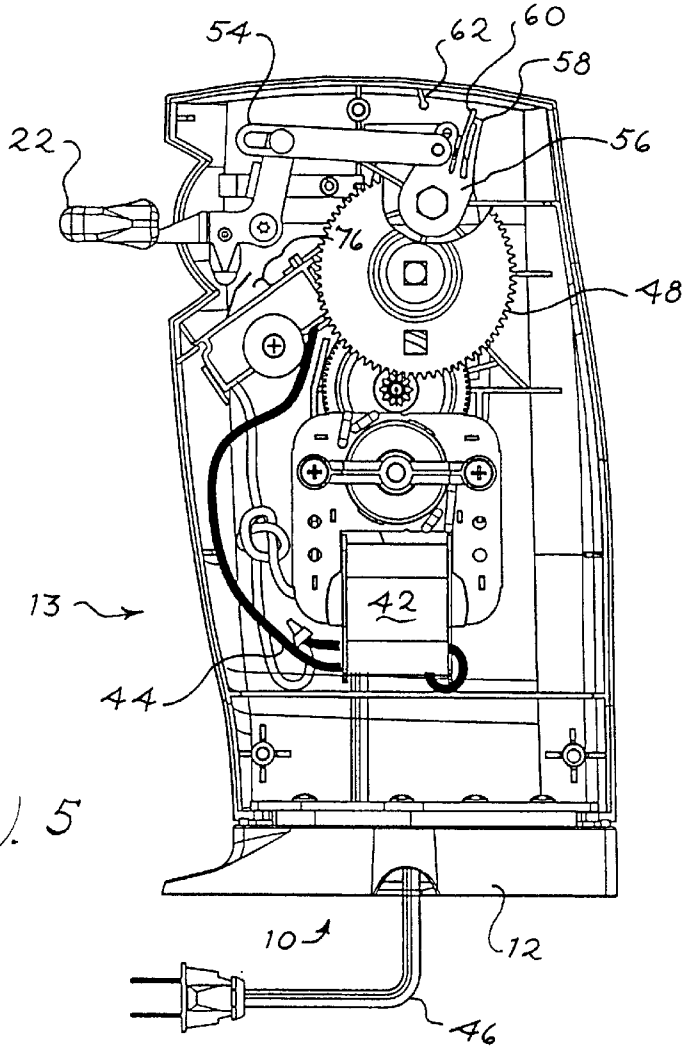
FIG. 5 is a side view of the internals of an embodiment of the invention.

FIG. 5 is a side view of the internals of a can opener 10 of the present invention. The can opener has a base portion 12 and a housing portion 13 containing the working parts of the can opener. A motor 42 is typically connected through connector 44 and electrical cord 46. The motor is connected to the serrated rotating wheel (not shown in this figure) through gear train 48, typically several spur gears in a gear reduction train such that a higher-speed motor can turn the serrated feed wheel at a slower speed, and with more torque for opening cans. Depressing operating lever 22 activates the opener, by causing switch contacts 76 to close and supply power to the serrated rotating wheel. Depressing lever 22 also activates linkage 54 to set up an opposing spring cutter control 56 that automatically shuts off the motor when the lid has been severed from the can.

In order to use the invention, as depicted in FIG. 1, the ergonomic can opener is placed on a kitchen counter-top, with the front 12*a* of the base 12 oriented toward the front of the counter-top, that is, in the direction of the person who will use the can opener. Since front 12*a* is curved, we cannot say the front of the can opener is parallel to a countertop, but as seen in FIG. 2, sides 12*b* and 12*c* are perpendicular to countertop 100. This is one way an owner may distinguish a preferred frontal orientation of the can opener. A can to be opened is placed adjacent the can guide 24 while the user lifts the operating lever 22 to move the magnet assembly 34 out of the way of the can. The can is placed such that its lip is atop the serrated rotating wheel 26, and the operating lever 22 is then depressed, bringing a cutting surface 30 into contact with the top of the can. The serrated wheel bites into the lip of the can, and the lever activates the motor, which causes rotation of the can. While this occurs, the cutting surface separates the lid from the body of the can. When the operating lever is depressed, it causes the magnet assembly 34 to contact the lid of the can, and a magnet in the magnet assembly attaches itself to the lid. When the lid is severed from the can, a spring, which opposes the motion of the operating lever, causes a switch in the motor circuit to open, thus stopping the motor and the rotating wheel. The magnet holds onto the lid of the can and prevents it from sinking into the contents of the can. The can is then removed from the can opener and the opening operation is completed.

The embodiment shown in FIGS. 1–5 is not the only way to practice the invention. While an angle of 45 degrees counter-clockwise is useful, any angle that allows a user to see the serrated rotating wheel is covered by the invention. It will also be recognized that angles from about 30 degrees to a full 90 degrees will provide the benefits of the invention. As applied to FIG. 2, this would be angle A, between base side 12*e* and housing side 16. That is, angle A, zero degrees in a conventional can opener, may be anywhere between about 30 and 90 degrees in a can opener made according to this invention. Angle B, 90 degrees in a conventional can opener, is 90 degrees minus angle A. Angle A and Angle B are complementary in this construction, that is, angle A+angle B equal 90 degrees. Thus, in a can opener according to this invention, angle B may be between sixty and zero degrees. In a preferred embodiment of the invention, the right-angle orientation of the operating lever with respect to the rotating wheel-magnet assembly axis does not change. They remain at about right angles to each other for ease of manufacture, assembly, and operation. Angle A is the angle referenced in the claims.

Figure 6A:
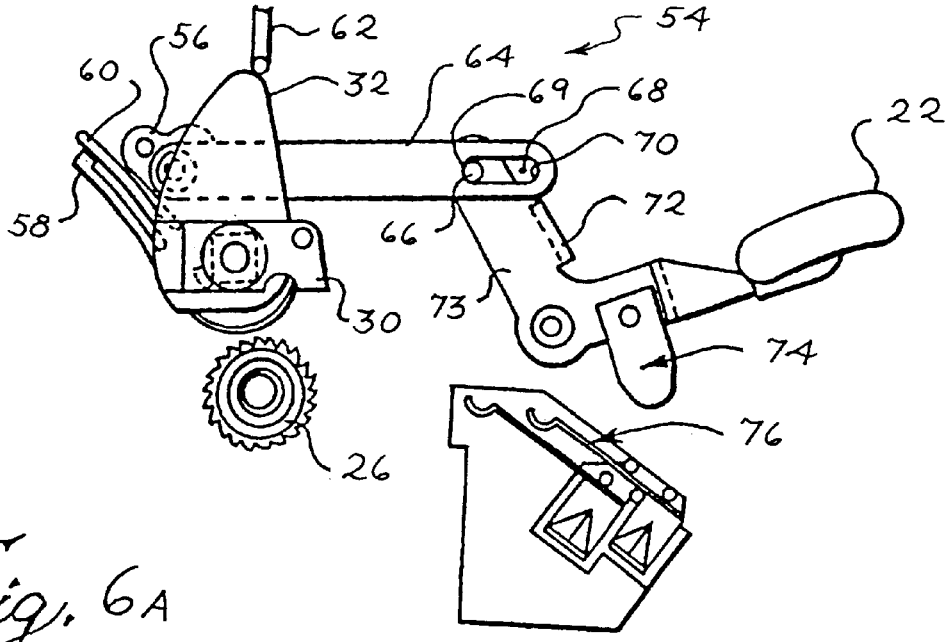
FIGS. 6*a* through 6*d* are side views of the internal parts of an embodiment of the invention.

A more detailed view of the internals of the can opener is illustrated in FIGS. 6*a* through 6*d*. In FIG. 6*a*, the operating mechanism is seen at rest. It includes the operating lever 22 and a linkage system 54, which transmits a force through a lever 73 and a lever extension 74 to close switch contacts 76 to operate a motor. Lever 73 has a pin or rivet 66 that interfaces with arm 64. Also included as part of the linkage are the arm 64 having a slot 68 with a front edge 69 and a rear edge 70. The arm is operably connected to spring cutter control 56. Spring cutter control 56 includes a biasing arm 58 and a spring arm 60, as well as a control boss 62. Operably connected to the operating lever is cutter 30 as part of a cam 32 for bringing a can (not shown) into contact with rotating wheel 26.

Figure 6B:
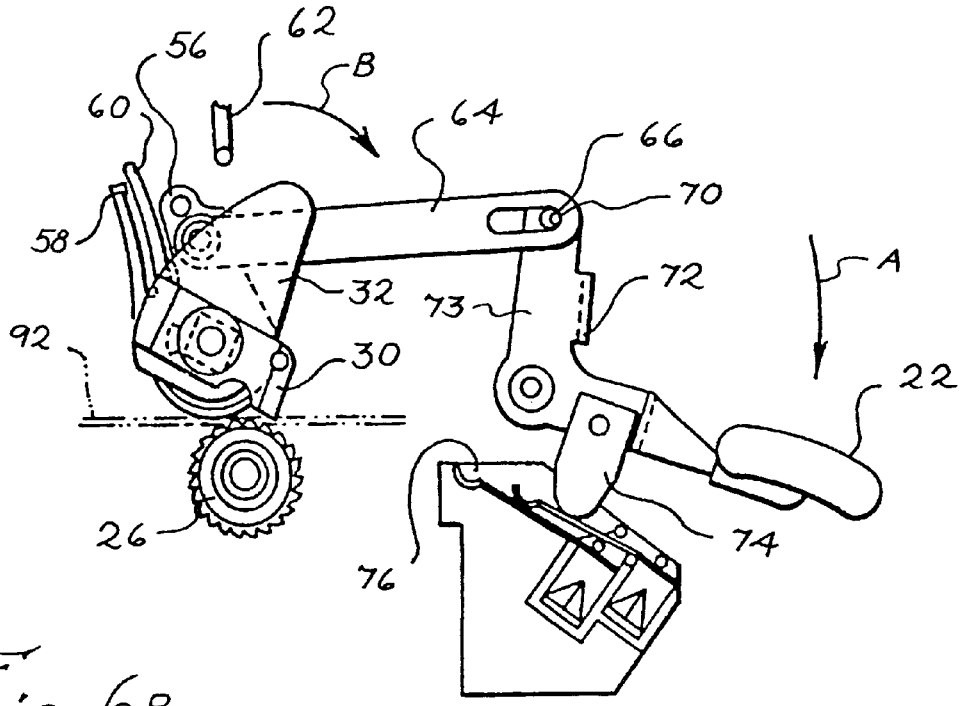
Figure 6C:
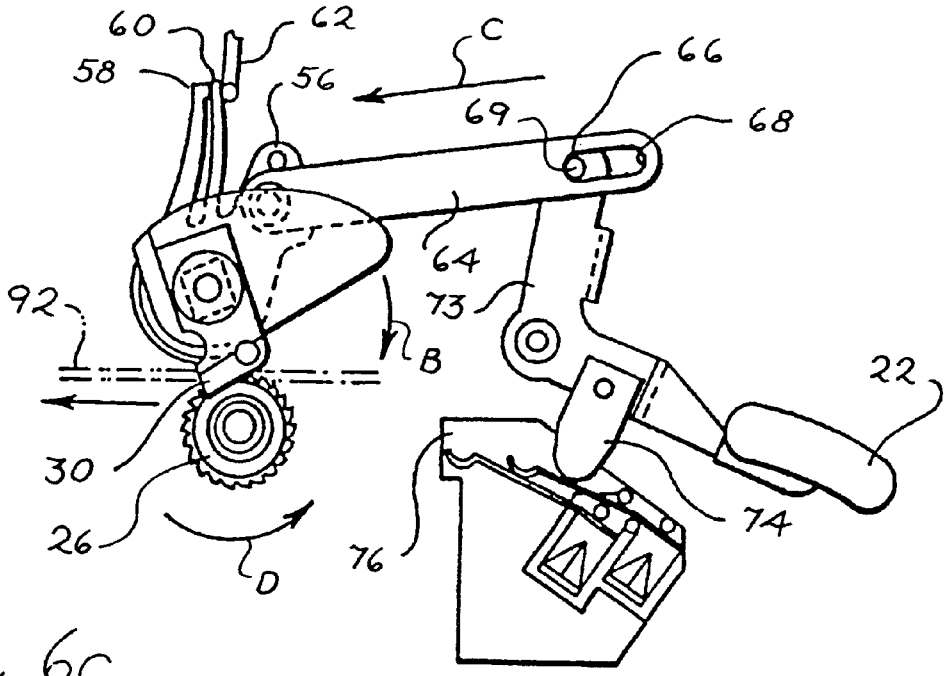

FIG. 6*b* illustrates the operation of the can opener when a can 92 is placed into the can opener and operating lever 22 is depressed in the direction of arrow A. Lever extension 74 causes switch contacts 76 to close, starting a motor (not shown) and causing rotating wheel 26 to rotate, turning the can. When lever 73 moves clockwise, arm 64 moves to the right with its rear edge 70 in contact with rivet 66. This causes rotation of the cam 32 and the cutter 30 in the direction of arrow B, causing cutter 30 to pierce the can 92 and begin removal of the lid of the can. Also rotating in the direction of arrow B is the spring cutter control 56, with its biasing arm 58 and spring arm 60, bringing them closer to control boss 62. These levers are an Easy Touch® feature marketed by the assignee of the present invention, and are disclosed in U.S. Pat. No. 5,313,708, incorporated herein by reference. These levers allow a user to operate the can opener by applying about 1 pound of force to the operating lever 22, a minimal force that enables persons afflicted with arthritis to more easily use the can opener of the present invention. The removal of the lid continues in FIG. 6*c*. The arms 58, 60 of the cutter control 56 are now in contact with the control boss 62, setting up a force along arrow C opposing the previous motion, through the spring force of spring arm 60 on control boss 62. This causes arm 64 to shift in the direction of arrow C, aligning rivet 66 in the front edge 69 of slot 68. Cam 32 continues its motion in the direction of arrow B, with cutter 30 continuing to open can 92 by the rotation of wheel 26 in the direction of arrow D.

Figure 6D:
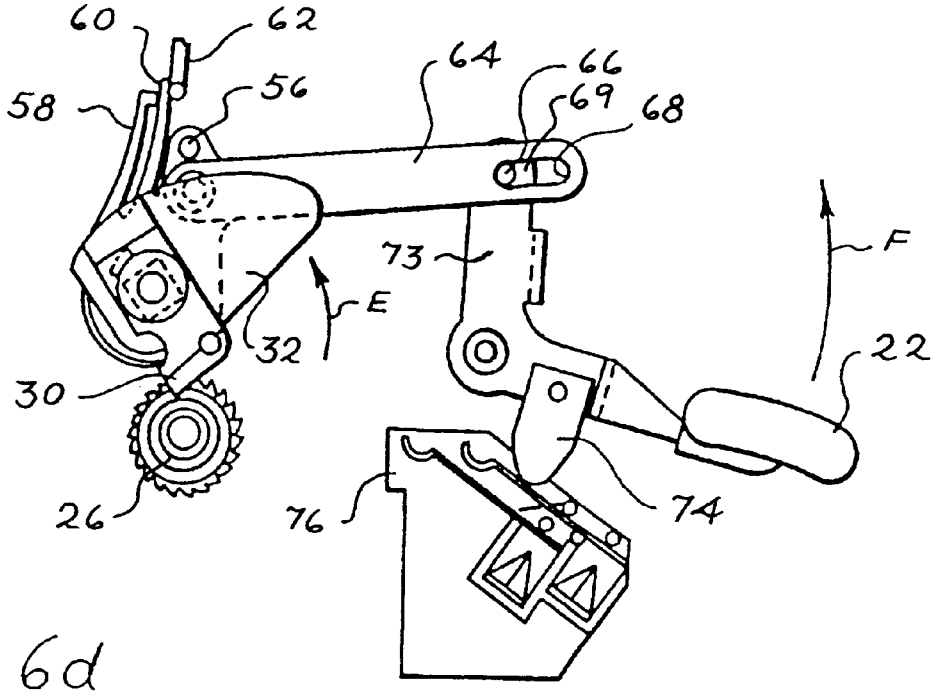

When the can is opened, as in FIG. 6*d*, there is no longer a force exerted by the rotating wheel to keep the can in place between the cutter 30 and the rotating wheel 26. With the relaxation of that force, the spring force set up by the spring arm 60 acting on boss 62 causes the cutter and the cam to rotate in the direction of arrow E. With the slot 68 and its front edge 69 aligned with rivet 66, as in FIG. 6*c*, this causes lever 73 to also rotate in the direction of arrow F. This causes lever extension 74 to move away from switch contacts 76, opening the switch and stopping the motor. Thus, in this embodiment of the invention, the opening of the can causes the motor to automatically stop.

Figure 7:
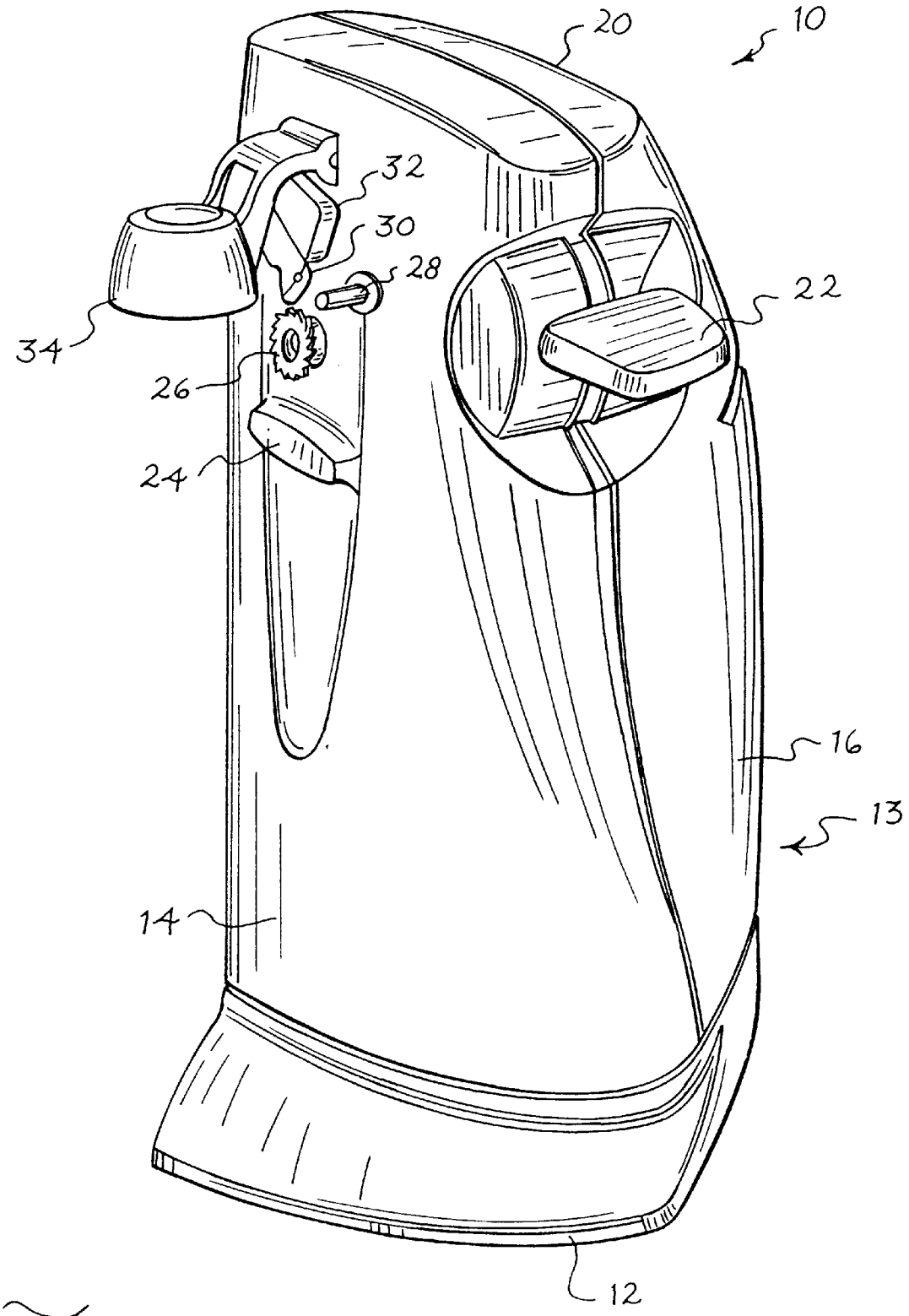
FIG. 7 is a perspective view of a second embodiment of the invention.
Figure 8:
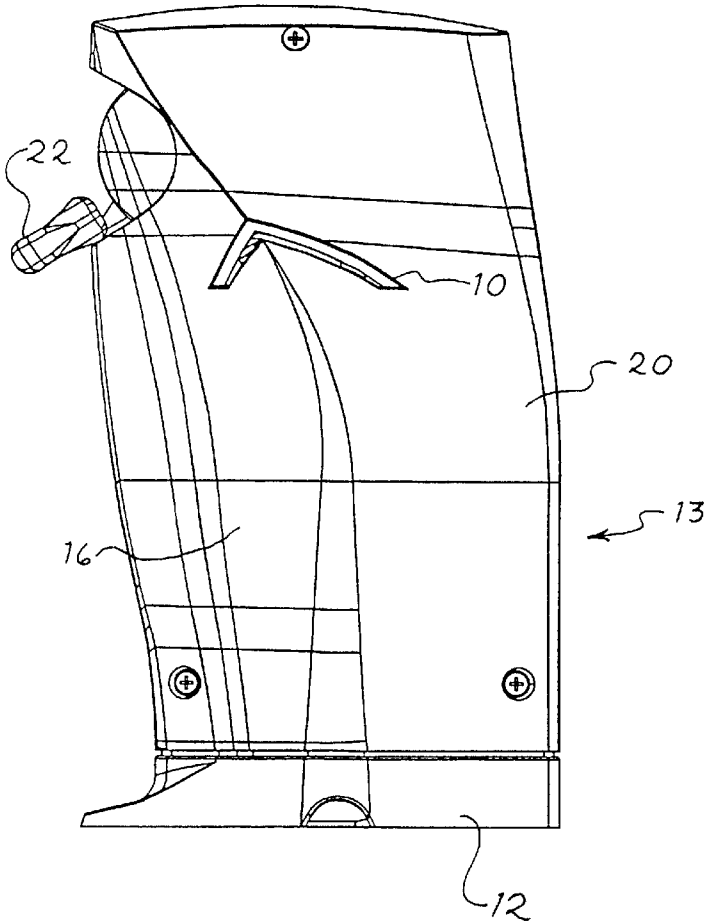
FIG. 8 is a rear view of the second embodiment of the invention.

While a four-sided appliance is certainly useful, the benefits of the ergonomic can opener may be implemented in other configurations as well. FIG. 7 depicts an embodiment in which the base 12 of the ergonomic can opener 10 includes four sides and a larger base for stability, but the upper operable part of the can opener, including housing 13, has only three sides, an angled front side 14, right side 16 and rear side 20. Front side 14 is angled at about 45 degrees to the base. Because of this configuration, with the housing rotated clockwise from the base, a user approaching from the front can see the top portion of the serrated rotating wheel and need not grasp and rotate the can opener to comfortably operate it. The user will preferably insert a can at the approximately 45-degree angle using a left hand. The operating lever, at about a 90 degree angle to the axis of approach of the can, is located on a line at about the junction of the front 14 and right side 16 of the housing of the ergonomic electric can opener. Thus, this embodiment preserves the right-angle orientation of the can opener's working parts. At the same time, the user need not grasp and orient the can opener to use it, and the wide base insures the greater stability sought in the can opener. FIG. 8 provides a rear view of this embodiment of the invention. Base 12 supports housing 13, with "right" side 16 and "rear" side 20 visible. Also shown is operating lever 22, and an opening 40 molded into the housing 13 to provide access to sharpening steels or ceramics should the can opener be equipped with an optional sharpening device for such use.

FIG. 9 provides a top view of this embodiment, in which base 12 is seen to be square or rectangular, having four sides, 12*a*, 12*b*, 12*c*, and 12*d*, while there are only three sides to the housing 13, that is, the front 14, right 16 and rear 20 sides. The front of the can opener is cued by the base and its front side 12*a*, parallel to countertop edge 100, while the user is visually cued to the rear side 12*c* of the can opener via electrical cord 46. A user approaching the properly-oriented can opener from the front along line 110 will be able to see the operating lever 22 and top of the feed wheel (as shown in FIG. 7) without having to touch or orient the can opener. A user approaching from the front along axis 110 will insert the can along axis 120 while using operating lever 22 along axis 130. It will be appreciated that the angles between axes 110–120 and 110–130 are about 45 degrees, while there is a right angle between axes 120–130 It is not essential that the 45 degrees illustrated be strictly maintained to practice the invention. Angle A in a conventional can opener is zero degrees, while angle A between 30 and 90 degrees is sufficient to encompass this invention. Angle B is complementary to angle A, that is, angle B+angle A will equal 90 degrees. Thus, while angle B is ninety degrees in a conventional can opener, angle B will be between zero and 60 degrees in this invention. Angle A is the angle referenced in the claims.

Figure 10:
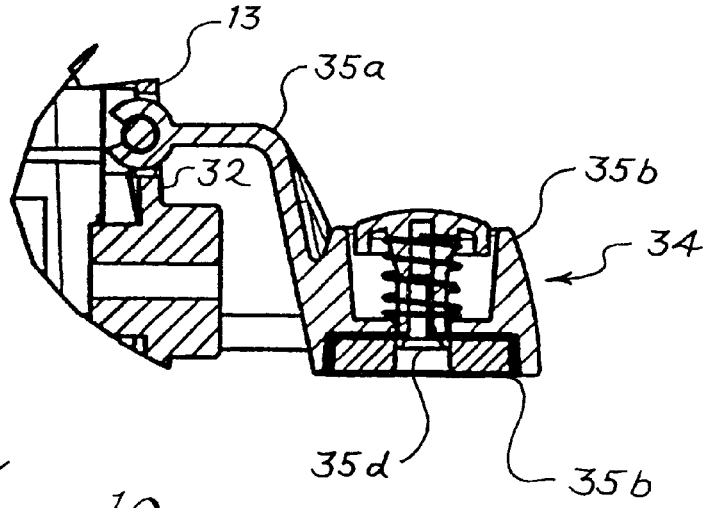
FIG. 10 is a cross-sectional view of a magnet assembly of the present invention.
Figure 11:
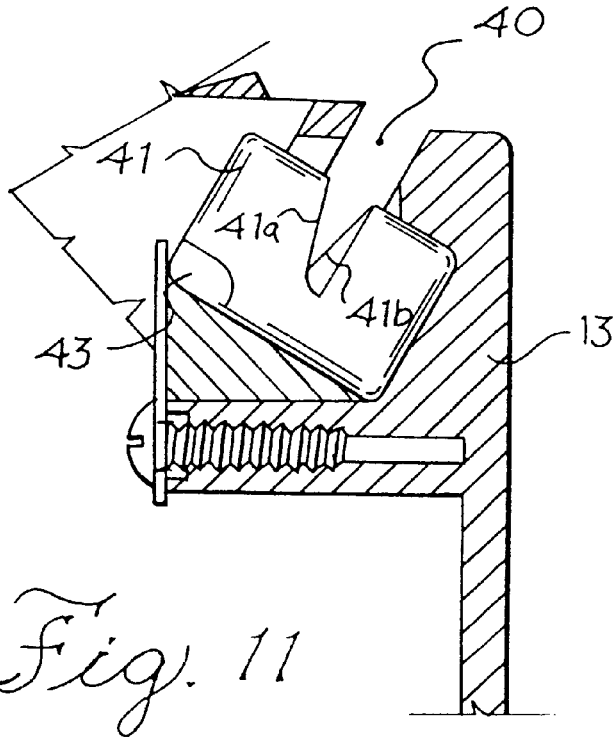
FIG. 11 is a cross-sectional view of a blade sharpener.

In another aspect of the invention, shown in FIG. 10, the lid of the can is retained by the magnet assembly 34, preventing the severed lid from falling into the can 92. FIG. 10 depicts the magnet assembly 34, connected to housing 13 through an L-shaped arm 35*a*. The assembly also includes a magnet 35*b* and a spring 35*c* secured by a fastener 35*d*. The magnet assembly is moved by the action of the cam 32, moving in concert with the cam and the operating lever (not shown in this figure). In another embodiment of the invention, a sharpener for household objects, such as knives or scissors, may also be included. FIG. 11 depicts one such sharpener, a ceramic sharpener 41, held in place by mounting device 43 inside housing 13. Access to the sharpener is through longitudinal opening 40, also depicted in FIG. 8. Shown are two surfaces 41*a*, 41*b* of the sharpener.

The can openers of the present invention may be manufactured from any suitable materials, including thermoset materials, metals, or thermoplastic materials. Molding allows the automatic and accurate placement of internal bosses and features useful in assembling the internal parts of the can opener. In a preferred aspect of the invention, the bases and the housings are molded from thermoplastic materials, in order to provide lightweight materials at low cost. It is also preferred to mold such can openers in several parts for ease of assembling both the external parts and the internal parts. While the base is advantageously molded in a single piece, the housing is better molded in two sections, so that the internal parts may be assembled inside and then the can opener closed by assembling the housing to the base with the internal parts assembled inside. Any suitable plastics may be used, including nylons, polyesters, ABS, HDPE, Lexan, and polycarbonates. In a highly preferred mode, can openers made from ABS are injection molded quickly and easily at low cost. A variety of colors are also available in these materials, allowing for more manufacturing and consumer preference options.

While this invention has been shown and described in connection with the preferred embodiments, it is apparent that certain changes and modifications, in addition to those mentioned above may be made from the basic features of this invention. For example, angles other than 45 degrees may be used to angle the sides of the can opener from the base without departing from the invention. Any angle that allows a user to see the serrated rotating wheel without moving or re-positioning the can opener will work. The invention thus far has been largely directed to use by a right-handed person, with the features of the can opener being a serrated wheel on the left and an operating lever on the right. The invention will work as well with an operating lever on the left side and a serrated feed wheel on the right. While this invention incorporates other improvements, such as a minimum of force to close the internal operating switch and begin opening a can, it is not necessary to include such refinements, and a can opener without an Easy Touch® feature will work as well for the intended purpose of allowing an easier line of sight. Nor is it necessary to cause the can opener rotating wheel to stop automatically, although this feature certainly is convenient to users. Accordingly, it is the intention of the applicants to protect all variations and modifications within the valid scope of the present invention. It is intended that the invention be defined by the following claims, including all equivalents.

I claim:

1. An electric ergonomic can opener, comprising:

a housing;

a motor mounted within the housing;

a switch mounted within the housing and connecting a source of electric power to the motor;

a feed wheel mounted on a shaft and operably connected to the motor, for rotating a can;

an operating lever substantially perpendicular to the feed wheel shaft, mounted on the housing and operating the switch; and a cutter mounted on the housing and operably connected to the operating lever, wherein the feed wheel shaft and the operating lever are each oriented substantially at an angle of about 45 degrees to a front of the can opener.

2. The can opener of claim 1, further comprising a base, wherein the housing is mounted on the base at an angle of about 45 degrees to the base, and the feed wheel shaft and the operating lever are each oriented substantially at an angle of about 45 degrees to the base.

3. The can opener of claim 1, further comprising a base, wherein the housing is mounted on the base at an angle from 30 to 90 degrees from the base, and at least one side of the base is parallel or perpendicular to the front edge of the countertop.

4. The can opener of claim 1, wherein the operating lever and the top of the feed wheel are visible to a user from the front of the can opener, without having to move the can opener.

* * * * *